US005702596A

United States Patent [19]

Juple et al.

[11] Patent Number: 5,702,596

[45] Date of Patent: Dec. 30, 1997

[54] ROOF WATER INLET

[75] Inventors: Pierre Juple; Heinz Haesler, both of Jona, Switzerland

[73] Assignee: Geberit Technik AG, Jona, Switzerland

[21] Appl. No.: 495,519

[22] PCT Filed: Nov. 29, 1994

[86] PCT No.: PCT/CH94/00229

§ 371 Date: Jul. 10, 1995

§ 102(e) Date: Jul. 10, 1995

[87] PCT Pub. No.: WO95/15423

PCT Pub. Date: Jun. 8, 1995

[30] Foreign Application Priority Data

Dec. 1, 1993 [CH] Switzerland ..... 3577/93

[51] Int. Cl.[6] ..... E04D 13/04

[52] U.S. Cl. ..... 210/166; 210/163; 210/232; 210/248; 210/460; 52/302.1

[58] Field of Search ..... 210/163, 166, 210/232, 248, 456, 460, 414; 285/42, 176; 52/12, 302.1

[56] References Cited

U.S. PATENT DOCUMENTS

| | | | |
|---|---|---|---|
| 1,791,512 | 2/1931 | Schurman . | |
| 2,079,269 | 5/1937 | Williams | 210/163 |
| 2,142,343 | 1/1939 | Boosey | 210/166 |
| 2,328,315 | 8/1943 | Warren . | |
| 3,517,813 | 6/1970 | Thaler | 210/166 |
| 4,492,491 | 1/1985 | Lundèn et al. | 210/163 |
| 4,652,365 | 3/1987 | Ebeling | 210/163 |
| 4,683,685 | 8/1987 | Ebeling et al. | 210/163 |
| 4,799,713 | 1/1989 | Uglow | 210/163 |
| 5,458,769 | 10/1995 | Johannessen | 210/163 |

FOREIGN PATENT DOCUMENTS

| | | |
|---|---|---|
| 58 193 | 8/1980 | Finland . |
| WO83/03114 | 9/1983 | Finland . |
| 26 50 361 | 7/1977 | Germany . |
| WO84/04126 | 10/1984 | Sweden . |

*Primary Examiner*—Neil McCarthy
*Assistant Examiner*—Theodore M. Green
*Attorney, Agent, or Firm*—McGlew & Tuttle

[57] ABSTRACT

A water collection trough has an edge arranged in the plane of a roof and a bottom, arranged with spacing from the edge, with an opening. The opening leads to a drainage pipe mounted down at the bottom of the trough. Two parallel plates are arranged spaced apart, a lower plate being fixed in the water collection trough and an upper plate being fixed above the edge of the water collection trough. The edge of the upper plate projects beyond the edge of the water collection trough in such a way that, to form a closed flow in the drainage pipe. The water to be led away is accelerated ahead of the edge of the water collection trough and, after a two-fold deflection of about 90° in each case, ahead of the opening in the bottom.

19 Claims, 2 Drawing Sheets

ROOF WATER INLET

FIELD OF THE INVENTION

The invention relates to a roof water inlet having a water collection trough, which has an edge to be arranged in the plane of a roof and a bottom arranged with spacing from the edge with an opening. The opening leading to a drainage pipe mounted down at the bottom, and has a plate which is arranged above the opening in the bottom. The edge of the plate extending beyond the opening.

BACKGROUND OF THE INVENTION

Roof water inlets of this type have been disclosed by U.S. Pat. No. 1,791,512, DE-A-1,948,214 and DE-A-2,650,361. These each have a plate above the mouth of the drain, which plate is intended to prevent air from being sucked in thus to bring about a closed flow in the drainage pipe. A closed flow allows pipes to be filled completely, compared to roof drainage without closed flow, this allows smaller tube dimensions, fewer roof water inlets for a given roof area and thus also requires less space and less expenditure for assembly.

In the known roof water inlets, the difficulty is now that the capacity is greatly dependent on the quantity of water and, in particular, a desirable, smooth and continuous drainage is not guaranteed in every case. In these roof water inlets, one problem continues to be the risk of blockage, for example due to foliage, which has entered the water collection trough.

SUMMARY AND OBJECTS OF THE INVENTION

The invention is based on the object of providing a roof water inlet of the type mentioned, which works more smoothly and continuously with less risk of blockage and has an improved capacity over the entire water quantity range.

In the roof water inlet according to the generic type, the object is achieved in that two plates are arranged spaced apart, a lower plate being arranged in the water collection trough and an upper plate being arranged above the edge of the water collection trough, and the edge of the upper plate projecting beyond the edge of the water collection trough in such a way that, to form a closed flow in the drainage pipe. The water to be conducted away is accelerated ahead of the edge of the water collection trough and, after a two-fold deflection by about 90° in each case, ahead of the opening in the bottom. In the water inlet according to the invention the acceleration route is considerably longer compared to the known roof water inlets. By means of a suitable arrangement of the two plates, it is possible to reduce the passage cross-section for the water in stages, seen in the direction of flow, and thus to achieve a higher flow velocity in the drainage pipe and thus a higher drainage capacity. The higher water velocity and the multiple deflection of the water bring about improved self-cleaning of the water collection trough. The longer acceleration route additionally guarantees a smoother and more continuous flow. With a comparatively small quantity of water, a closed flow is guaranteed at least by the lower plate. Tests have shown that, with an internal pipe cross-section of 50 mm, a drainage capacity of about 12 liters per second can be achieved. A closed flow is thus guaranteed with small and large quantities of water and, with large quantities of water, the capacity is considerably higher than in the case of inlets of similar size having only one plate. A considerable advantage of the invention is also seen in the fact that, owing to the higher capacity, fewer different roof water inlets have to be produced and kept in store for different national regulations.

Since, in the roof water inlet according to the invention, two plates are provided, arranged spaced apart, it is possible to fix the lower plate on the upper plate so that the lower plate can then be held freely on its underside and consequently requires no fixing means here, which in turn reduces the risk of blockage and results in a smoother flow. Additionally, it is possible to design the two plates and, if appropriate, a foliage trap and a gravel ring as a unit and to fix it releasably on the water collection trough. According to a further development of the invention, the two plates can additionally be connected to one another by a central pipe, it being possible for said pipe to serve as an overflow at the same time.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
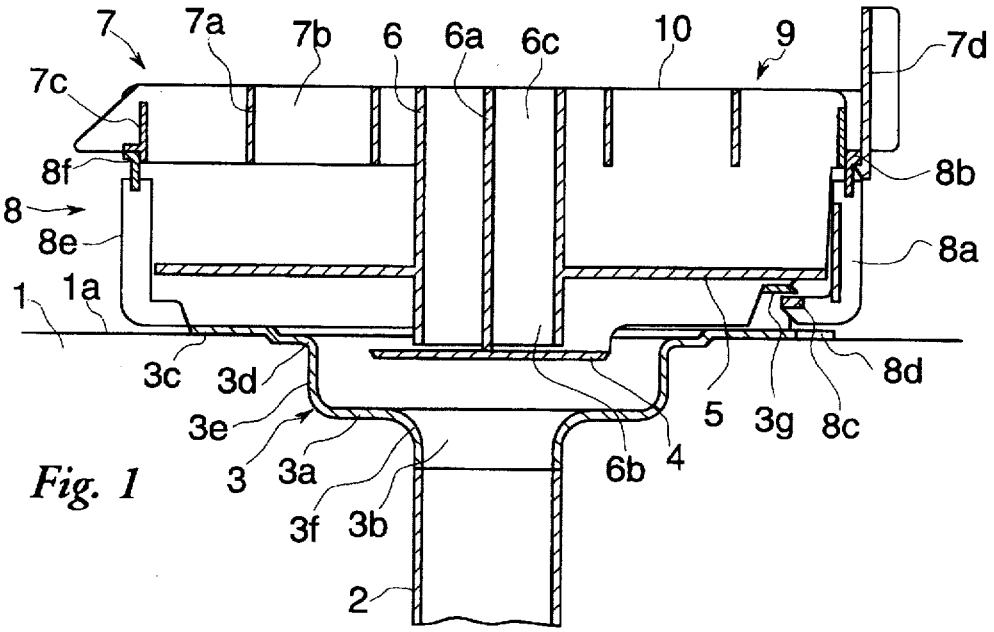
FIG. 1 shows a vertical section through an installed roof water inlet according to the invention, FIGS. 2 and 3 each show a section through one half of the roof water inlet according to the invention to illustrate the flow conditions.
Figure 4:
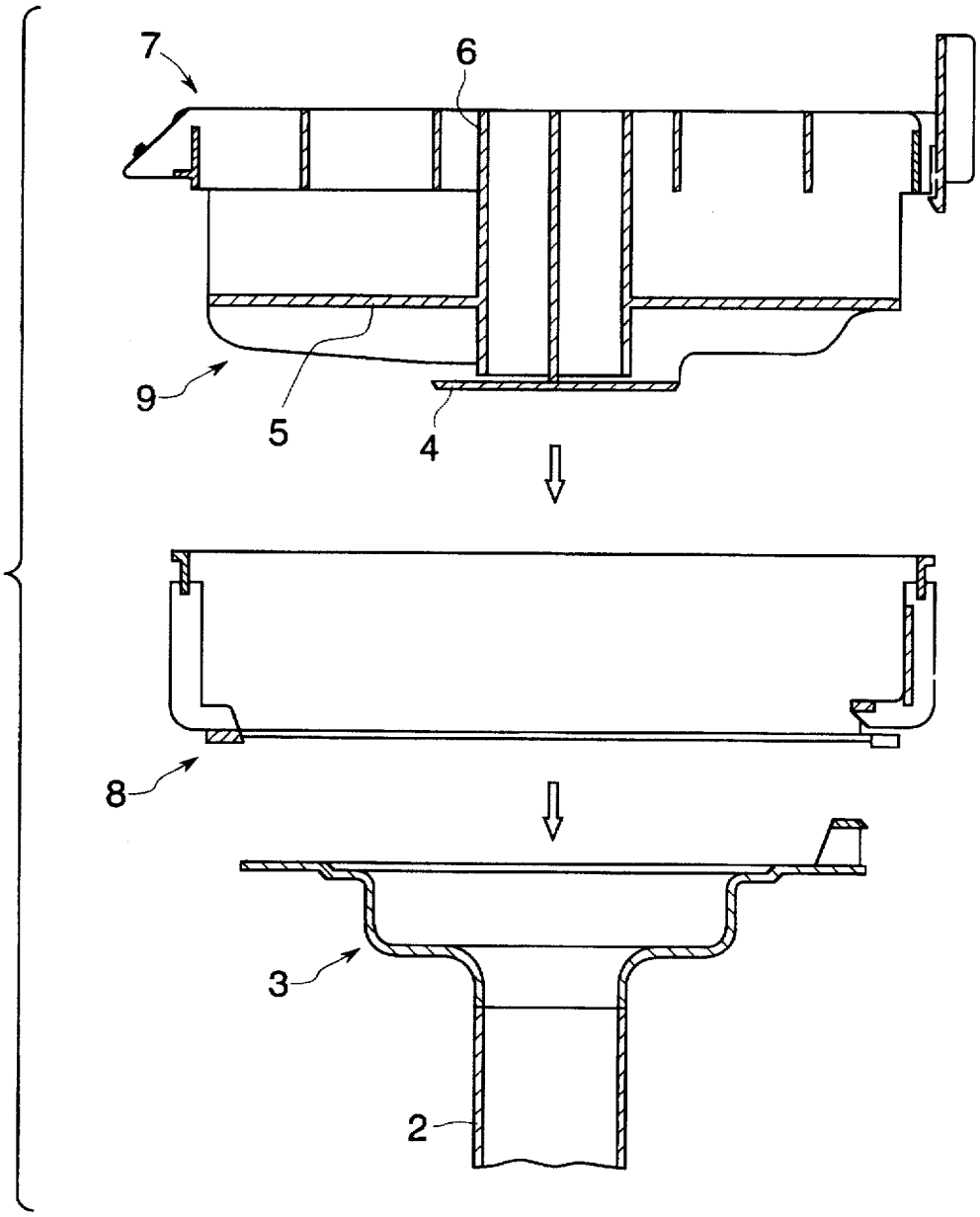
FIG. 4 shows a section through the separated parts of the roof water inlet according to the invention.

FIG. 1 shows a section of a region of a roof 1 with a horizontal roof plane 1*a* in which a roof water inlet 10 according to the invention is installed. Any roof insulation as well as sealing means and fixing means are not shown here since these are known per se. As additionally shown in FIG. 4, the roof water inlet 10 is composed of a water collection trough 3, a gravel ring 8 and an upper unit 9. These parts, 3, 8 and 9 are produced separately from a suitable plastic material and are preferably releasably connected to one another. To clean the roof water inlet, the unit 9 and the gravel ring 8 can be removed from the water collection trough 3.

The water collection trough 3 has a collar 3*c* which extends radially outwards, is arranged in the roof plane 1*a*, and is moulded onto an inner edge 3*d* on an approximately vertical through wall 3*e*. The wall 3*e* is, in turn, moulded onto a bottom or pan 3*a* in which a circular drain opening 3*b* is cut out in the middle. The opening 3*b* leads into a drainage pipe 2. The upper end of the drainage pipe 2 is welded onto a nozzle 3*f* of the water collection trough or is tightly connected thereto in another manner. Water flowing from the roof plane 1*a* into the water collection trough 3 is thus led through the opening 3*b* into the drainage pipe 2.

Moulded onto the upper side of the collar 3*c* in a distributed manner are a plurality of holders 3*g* which project upwards. Into each of the holders 3*g* a tooth 8*c* of a web 8*a* of the gravel ring 8 is engaged. The gravel ring 8 thus has a plurality of webs 8*a* which are distributed over its circumference and are each fixed releasably to the water collection trough 3 by a catch connection. The gravel ring 8 additionally has a plurality of webs 8*e* which are moulded onto a ring 8*d* which rests and is supported on the roof plane 1*a* adjacent to the outer edge of the collar 3*c*. The ring 8*d* particularly prevents lateral displacement of the gravel ring 8 in relation to the water collection trough 3. Moulded onto the webs 8*a* and 8*e* at the upper end in each case is a circumferential ring 8*b* which connects the webs to one another and has an outwardly projecting catch edge 8*f* on which the unit 9 is engaged. The webs 8*a* and 8*e* are arranged with a suitable spacing from one another and allow the passage of water to the water collection trough 3, but prevent the passage of gravel which is usually present on the roof plane 1*a*.

The unit 9 is inserted as a whole in the gravel ring 8 and is fixed by engagement with at least one catch arm 7*d* on the ring 8*b* of the gravel ring 8. The arm 7*d* can be pivoted slightly at its upper end to release the catch connection. The unit 9 has an overflow pipe 6 in the centre. The upper end of the overflow pipe 6 there is moulded a foliage trap 7 with vertical passage openings 7*b*, webs 7*a* and a circumferential ring 7*c* resting on the gravel ring 8. The said catch arm 7*d* is fixed on the foliage trap 7. A closed and circular plate 5, extending horizontally outwards, is moulded onto the outside of the overflow pipe 6 below the foliage trap 7. The plate 5 is arranged with spacing from the collar 3*c* and extends, as can be seen, beyond the edge 3*d* of the water collection trough 3. A lower plate 4 is fixed on an inner wall 6*c* of the overflow pipe 6 below the plate 5 and below an outlet opening 6*b* in the overflow pipe 6. The plate 4 is additionally connected, via vertically and radially extending walls 6*c* to the upper plate 5 and to the outside of the overflow pipe 6. As can be seen, the plate 4 is located slightly below the edge 3*d* and is greater than the opening 3*b* in the water collection trough 3.

The functioning of the roof water inlet according to the invention is explained in greater detail below with reference to FIGS. 2 and 3.

Figure 2:
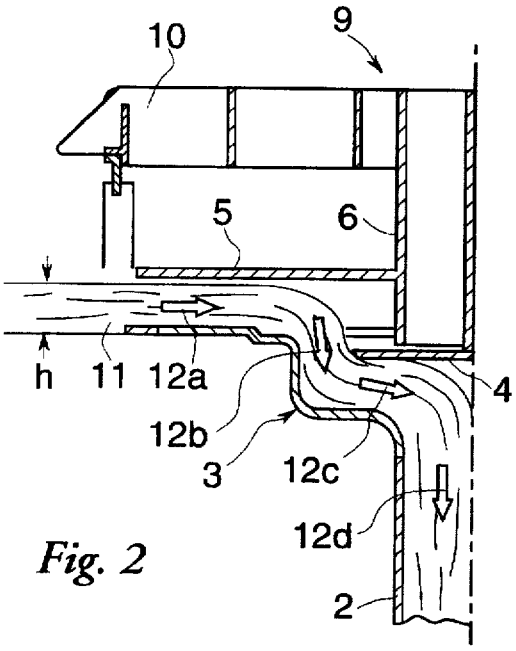

FIG. 2 shows a diagram of the flow pattern of a quantity of rain water 11, to be conducted away from the roof 1, with an overflow height h which is lower than the spacing of the upper plate 5 from the collar 3*c*. In the region of the collar 3*c*, the flow runs horizontally and radially in the direction of the arrow 12*a* and, here, is essentially unaffected by the upper plate 5. At the edge 3*d*, the water 11 is deflected according to arrow 12*b* downwards by about 90° and passes between the wall 3*e* and the outer edge of the lower plate 4 into the water collection though 3. After a further deflection at the bottom 3*a*, the water 11 passes under the lower plate 4 and finally via the opening 3*b* into the drainage pipe 2. At the edge of the opening 3*b*, the water is again deflected from an approximately horizontal direction of flow according to arrow 12*c* by about 90° into a vertical direction of flow according to arrow 12*d*. In the region of the plate 4, the water 11 is accelerated by the narrowing passage and passes as a closed flow into the drainage pipe 2, the plate 4 preventing air being sucked in.

Figure 3:
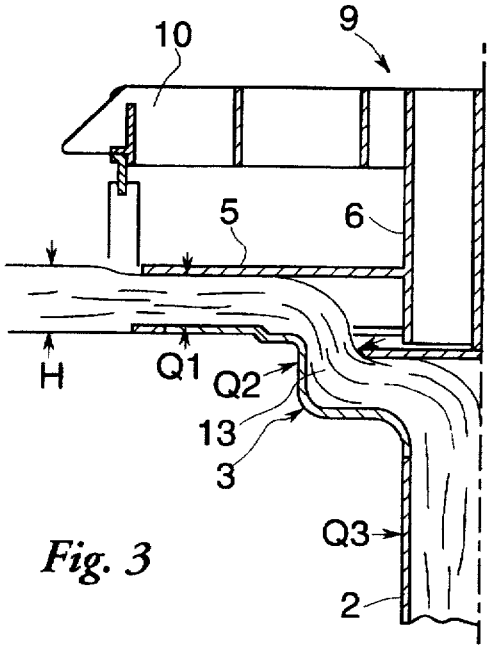

FIG. 3 shows a diagram of the flow conditions with a quantity of water 11 with an overflow height H which is higher than the spacing of the plate 5 from the collar 3*c*. In this case, the water 11 is already accelerated in the region of the collar 3*c* and passes, after a deflection by about 90°, through an annular or secondary opening 13 formed by the plate 4 and the wall 3*e*, under the plate 4 and finally into the drainage pipe 2. The water 11 is thus accelerated in the region of the collar 3*c* and also in the region of the plate 4. Since this is a closed flow, according to FIG. 3 the cross-section $Q_3$ of the drainage pipe 2 is smaller than the cross-section $Q_2$ of the annular opening 13, and the latter is in turn smaller than the cross-section $Q_1$ of the initial flow opening between the upper plate 5 and the collar 3*c*. On its path into the drainage pipe 2, the water is thus accelerated at three passage openings, becoming smaller in stages, and thus finally has a particularly high velocity in the drainage pipe 2.

If the opening between the plate 5 and the collar 3*c* is blocked by foliage, for example, in the case of a rising overflow height the water can pass into the overflow pipe through an upper opening 6*a* therein and finally through the lower opening 6*b* above the plate 4 radially outwards and into the collection trough 3. In the through 3, the water is accelerated by the plate 4, as explained with reference to FIG. 2 and likewise passes as a closed flow into the drainage pipe 2.

In the case of inspection, the unit 9 can be removed as a whole from the gravel ring 8 in a very simple manner by pivoting the catch arm 7*d*. The water collection trough 3 is then immediately and easily accessible from above. The gravel ring 8 can likewise be removed from the water collection trough 3 by pivoting the webs 8*a*. Fitting the pieces together then takes place in the reverse order, the gravel ring 8 and the unit 9 then each being engaged automatically when fitted on. An inspection can consequently be carried out in a very quick and simple manner.

While the specific embodiments of the invention have been shown and described in detail to illustrate the application of the principles of the invention, it will be understood that the invention may be embodied otherwise without departing from such principles.

We claim:

1. A surface drain comprising:

a collection trough with an outer edge substantially positionable in a drain plane of a surface to be drained, said trough including a pan spaced from the drain plane in a downstream direction, said pan defining a drain opening communicable with a drain pipe;

a first plate spaced from said drain plane on a side substantially opposite said pan to define an initial flow opening with said outer edge of said trough, said first plate and said outer edge forming a closed flow for fluid entering said initial flow opening and for accelerating the fluid prior to entering said initial flow opening;

a second plate positioned in said trough to twice deflect a flow of the fluid by substantially 90 degrees and also to accelerate the fluid prior to entering the drain opening;

means to hold said first and second plates in respective positions.

2. A drain in accordance with claim 1, wherein:

said trough includes a trough wall connecting said outer edge to said pan, said trough wall and said second plate defining a secondary opening, said secondary opening having a larger passage cross section than a passage cross section of a portion of the drain pipe adjacent said drain opening;

said initial flow opening having a passage cross section greater than said passage cross section of said secondary opening.

3. A drain in accordance with claim 2, wherein:

said secondary opening is an annular opening around said second plate.

4. A drain in accordance with claim 1, further comprising:

fixing means designed for repetitively connecting and disconnecting said one of said first and second plates from said trough without destroying said fixing means, said first plate, said second plate or said trough.

5. A drain in accordance with claim 4, wherein:

said fixing means includes a catch connection.

6. A drain in accordance with claim 1, wherein:

said first and second plates are connected to each other.

7. A drain in accordance with claim 1, further comprising:

an overflow duct leading though said first plate.

8. A drain in accordance with claim 7, wherein:

said overflow duct has an opening to lead fluid from said overflow duct against a side of said second plate substantially opposite said pan and direct the fluid radially outward from said overflow duct to said pan.

9. A drain in accordance with claim 8, wherein:

said first and second plates are connected to said overflow duct.

10. A drain in accordance with claim 7, wherein:

foliage trap means is connected to said first and second plates for blocking foliage from entering said trough;

said foliage trap means, said overflow duct, said first plate and said second plate are formed as a single homogeneous unit.

11. A drain in accordance with claim 7, wherein:

said first and second plates are directly connected to said overflow duct.

12. A drain in accordance with claim 1, further comprising:

foliage trap means connected to said first and second plates and for blocking foliage from entering said trough.

13. A drain in accordance with claim 12, wherein:

said foliage trap means, said first plate and said second plate are formed as a single homogeneous unit.

14. A drain in accordance with claim 1, further comprising:

gravel ring means for preventing gravel from entering said trough, said gravel ring means including connection means designed for repetitively connecting and disconnecting said gravel ring means to and from said trough without destroying said connection means, said first plate, said second plate or said trough.

15. A drain in accordance with claim 14, wherein:

said connection means includes a catch.

16. A drain in accordance with claim 14, wherein:

said gravel ring means connects said first and second plates to said trough.

17. A drain in accordance with claim 14, wherein:

foliage trap means is connected to said first and second plates for blocking foliage from entering said trough;

said gravel ring means connects said foliage trap means to said trough.

18. A surface drain comprising:

a collection trough with an outer edge substantially positioned in a drain plane of a surface to be drained, said trough including a pan spaced from the drain plane in a downstream direction, said pan defining a drain opening communicable with a drain pipe;

a first plate spaced from said drain plane on a side of said drain plane substantially opposite said pan to define an initial flow opening with said outer edge of said trough, said first plate and said outer edge forming a closed flow for fluid between said first plate and said outer edge and for accelerating the fluid prior to entering said initial flow opening;

a second plate positioned in said trough to define a secondary opening to form a closed flow in the drain pipe and to accelerate the fluid prior to entering the drain opening;

means to hold said first and second plates in respective positions.

19. A surface drain comprising:

a collection trough with an outer edge substantially positionable in a drain plane of a surface to be drained, said trough including a pan spaced from the drain plane in a downstream direction, said plane defining a drain opening communicable with a drain pipe;

a first plate spaced from said drain plane on a side substantially opposite said pan to define an initial flow opening with said outer edge of said trough, said first plate and said outer edge forming a closed flow for fluid entering said initial flow opening and for accelerating the fluid prior to entering said initial flow opening;

a second plate positioned in said trough to twice deflect a flow of the fluid by substantially 90 degrees and also to accelerate the fluid prior to entering the drain opening, said trough includes a trough wall connecting said outer edge to said pan, said trough wall and said second plate defining a secondary opening, said secondary opening having a larger passage cross section than a passage cross section of a portion of the drain pipe adjacent said drain opening, said initial flow opening having a passage cross section greater than said passage cross section of said secondary opening;

means to hold said first and second plates in respective positions.

* * * * *